US005794527A

United States Patent [19]

Brooks

[11] Patent Number: 5,794,527

[45] Date of Patent: Aug. 18, 1998

[54] CONVERGING PASSAGE CAN CRUSHER

[75] Inventor: Richard Phillip Brooks, Bakewell, United Kingdom

[73] Assignee: Tony Team Limited, Bakewell, United Kingdom

[21] Appl. No.: 618,938

[22] Filed: Mar. 20, 1996

[30] Foreign Application Priority Data

Mar. 25, 1995 [GB] United Kingdom ..... 9506125

[51] Int. Cl.[6] ..... B30B 9/32

[52] U.S. Cl. ..... 100/151; 100/902

[58] Field of Search ..... 100/45, 49, 91, 100/151–154, 902

[56] References Cited

U.S. PATENT DOCUMENTS

| | | | |
|---|---|---|---|
| 705,071 | 7/1902 | Graham | 100/154 |
| 1,140,676 | 5/1915 | Gray . | |
| 3,526,078 | 9/1970 | Dye | 100/151 |
| 3,645,199 | 2/1972 | Kanna | 100/49 |
| 3,691,942 | 9/1972 | Wagley . | |
| 3,971,310 | 7/1976 | Kondos et al. | 100/152 |
| 4,221,040 | 9/1980 | Good | 100/902 |
| 4,261,259 | 4/1981 | Beardslee . | |
| 4,995,314 | 2/1991 | Buer . | |
| 5,355,788 | 10/1994 | Phinney . | |
| 5,493,960 | 2/1996 | Miyao | 100/902 |

FOREIGN PATENT DOCUMENTS

| | | | |
|---|---|---|---|
| 0 082 735 | 6/1983 | European Pat. Off. . | |
| 2717119 | 9/1995 | France . | |
| 89 02 884 | 4/1989 | Germany . | |
| 5-200593 | 8/1993 | Japan | 100/902 |
| 5-318191 | 12/1993 | Japan | 100/302 |
| 2120592 | 12/1983 | United Kingdom . | |

*Primary Examiner*—Stephen F. Gerrity
*Attorney, Agent, or Firm*—Dellett and Walters

[57] ABSTRACT

A can crusher includes two endless belt assemblies arranged alongside each other with the mutually facing runs of said belt assemblies being arranged to define a converging gap therebetween in the direction of motion of the belt so that a can to be crushed fed into the converging space is progressively crushed as it moves between the belts. One of the belt assemblies is pivotally mounted relative to the other such that the angle of convergence can vary, the conveyance movement being controlled by, for example, gas-springs.

19 Claims, 5 Drawing Sheets

CONVERGING PASSAGE CAN CRUSHER

BACKGROUND OF THE INVENTION

The present invention concerns improvements in or relating to can crushers, especially but not exclusively can crushers for drinks cans.

In view of the vast numbers of drinks cans used every day, it is important both ecologically and economically that the cans are re-cycled. This presents a problem in that the empty cans occupy a large volume. This problem can be overcome to a large extent if the cans are reduced in size by crushing them at the collection point so that their subsequent transportation and storage prior to re-cycling can be economically achieved.

There presently exists a number of can crushers, some of which are manually operated others of which are mechanically operated which are intended to crush cans at the collection point or even in the home. These suffer a number of disadvantages, for example, they are generally single operation machines, that is, they crush only one can per operation. Additionally, they have no means for separating steel cans from other cans. Furthermore, they can readily be rendered inoperative by feeding "foreign" objects into them.

There is a need to provide a can crusher which can operate continuously, that is on a "process" basis, can automatically separate magnetic crushed cans from other cans, will not be damaged or rendered inoperative by foreign bodies fed thereto and can operate reliably, safely and economically.

SUMMARY OF THE INVENTION

According to the present invention there is provided a can crusher including two endless belt assemblies arranged alongside each other with the facing runs of said belt assemblies being arranged to define a converging passage therebetween in the directional motion of the belts, one belt assembly being located above the other and one being pivotally mounted relative to the other whereby the angle of convergence of the passage and the gap between the belts at its smallest point are variable.

Preferably biasing means are provided to bias the endless belt assemblies towards the greatest angle of convergence, the biasing means including two gas springs each of which is mounted on plates mounting the first and second belt assemblies.

Preferably the first belt assembly is shorter than the second belt assembly.

Preferably the shorter belt assembly is mounted between two plates and the second, longer belt assembly is also mounted between two plates which are located between the plates of the first assembly, the plates of the first assembly being pivotally mounted about the axis of the leading guide roller for the belt of the first assembly.

Preferably the leading guide rollers for the first and second belts are driven by intermeshing gear wheels arranged externally of said plates, the guide rollers and gear wheels being the same diameter and having the same number of teeth such that the belts are driven at the same linear speed.

Preferably the leading and trailing guide rollers for each belt are toothed and the inner surface of each belt is correspondingly toothed.

Preferably the second belt assembly has an intermediate guide roller arranged alongside the trailing guide roller of the shorter, first belt assembly to define a nip at the inner end of the constricted space between the facing runs of the belt assemblies.

Preferably backing plates are arranged against the inner faces of said facing runs of each belt. Said inner faces and said backing plates may be coated with a material having a relatively low co-efficient of friction.

Preferably adjustable tensioning rollers are provided to co-act with the return run of each belt assembly to tension the belts.

Preferably said biasing means includes a gas spring. Two gas springs may be provided each being mounted at its respective ends on the plates mounting the first and second belt assemblies.

Preferably said gas springs are adjustable.

Preferably said gear wheels are driven through the intermediary of a spur gear and gear box by an electric motor.

Preferably can delivery means are provided to convey cans to the can crusher. This means may include a roller conveyor powered through appropriate transmission means by said electric motor.

Preferably said roller conveyor is semi-circular and extends between said can crusher and an inclined plane leading from an entry port to a casing enclosing the can crusher and the can delivery means.

Preferably means are provided to detect the introduction of a can to the can delivery means. Said means may comprise a proximity switch. Preferably said proximity switch is adapted to open means normally closing the entry port on detection of an object at the entry port. Preferably the proximity switch operates only when it detects items made from an electrically conductive material.

Preferably the proximity switch actuates the drive for the can crusher and can delivery means.

Alternative delivery means may employ the return run of the second belt assembly to convey cans to the first belt assembly.

Embodiments of the present invention will now be described by way of example only with reference to the accompanying drawings in which:

BRIEF DESCRIPTION OF THE DRAWINGS

FIG. 2 shows a view from a direction opposite to that in which FIG. 1 is taken of the can crusher;

DETAILED DESCRIPTION

Figure 1:
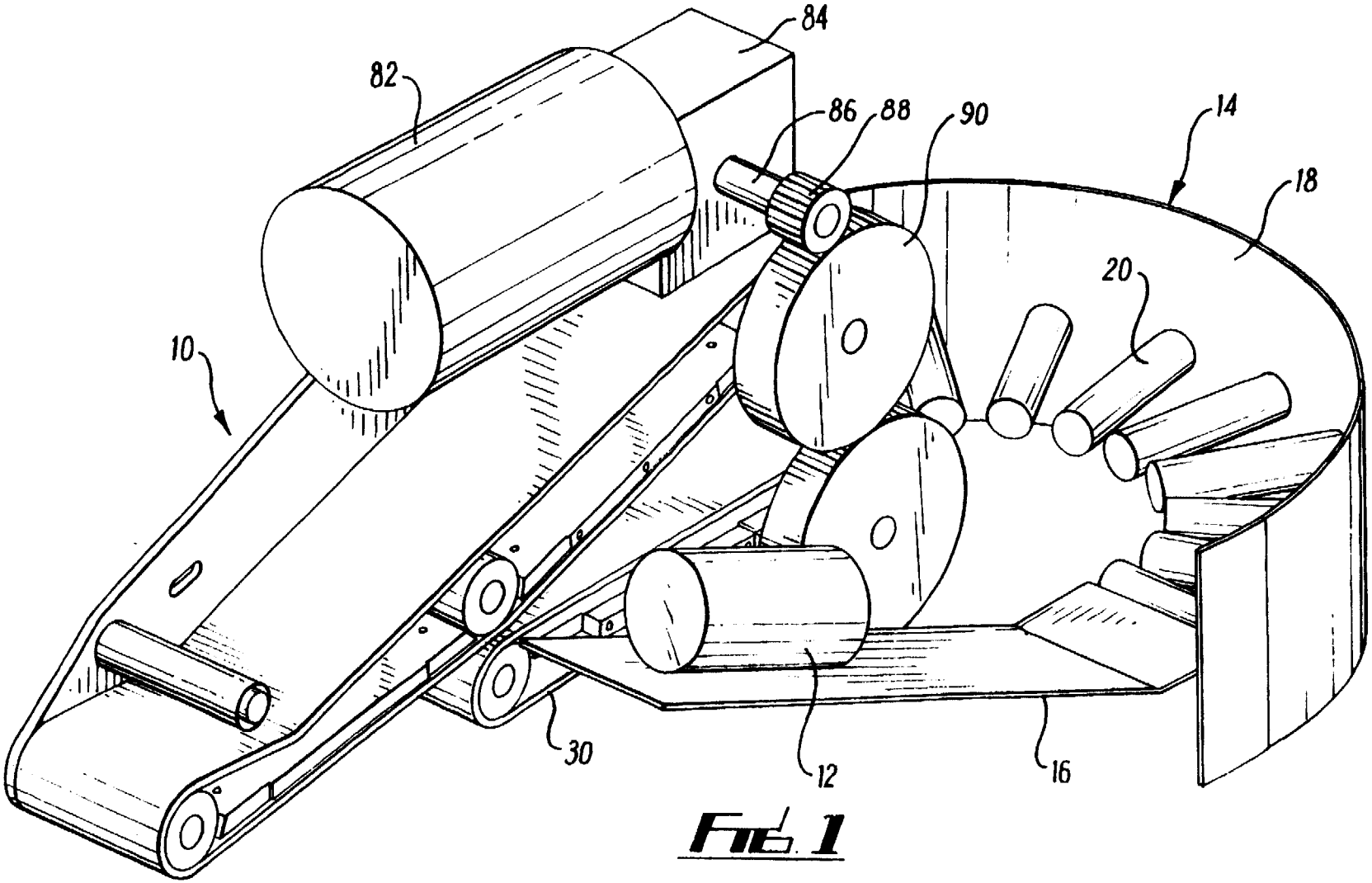
FIG. 1 shows a perspective view of an assembly comprising a can crusher and can delivery means, side plates of the can crusher and other non-essential components having been omitted for clarity.

FIG. 1 shows a can crusher 10, which will be described in greater detail below, to which cans 12 are fed by a can delivery means or can conveyor 14. The can conveyor and can crusher are mounted within a casing (not shown) which has an entry port having a closeable door, the entry port leading to an inclined plane 16 down which cans fed through the entry port can slide to a semi circular roller conveyor 18. The radially arranged rollers 20 of the roller conveyor are driven by means to be described below and transport cans 12 to the can crusher 10.

The crusher comprises a first conveyor belt assembly having an endless belt 30 which runs over a driven leading end guide roller 32 and a trailing end idler guide roller 34 mounted respectively on shafts 36,38. The shafts are mounted in bearings 40 supported in side plates 42 which are generally triangular in shape, that is the side plates extend upwardly from the line joining the axis of the shafts 36,38. The plates 42 have corresponding slots 44 formed therein and a tensioning roller 46 is mounted on a shaft which, in turn, is adjustably mounted between the slots 44 such that the first conveyor belt can be suitably tensioned.

A support plate 48 is provided below the upper run of the belt 30 and is mounted between the plates 42 by fixing bolts (not shown) passing through apertures 50 formed through the plates.

A second pair of spaced apart plates 52 are mounted between the plates 42. The shaft 36 passes through said second plates 52 and the plates 52 are pivotal, in unison, about said shaft relative to the plates 42.

A second endless belt 54 is carried by a driven leading guide roller 56, an idling trailing end guide roller 58 and an idling intermediate guide roller 60 mounted respectively on shafts 62,64,66 supported by bearings 68 in the plates 52.

A tensioning roller 70 is also mounted between the plates in corresponding slots 72 whereby its position and consequently the tension it exerts on the return run of the belt is adjustable.

The lower run of the belt 54 has support plates 74,76 placed alongside its inner surface, the support plates being mounted between the side plates 52 by bolts (not shown) passing through apertures 78 formed through the plate.

Figure 2:
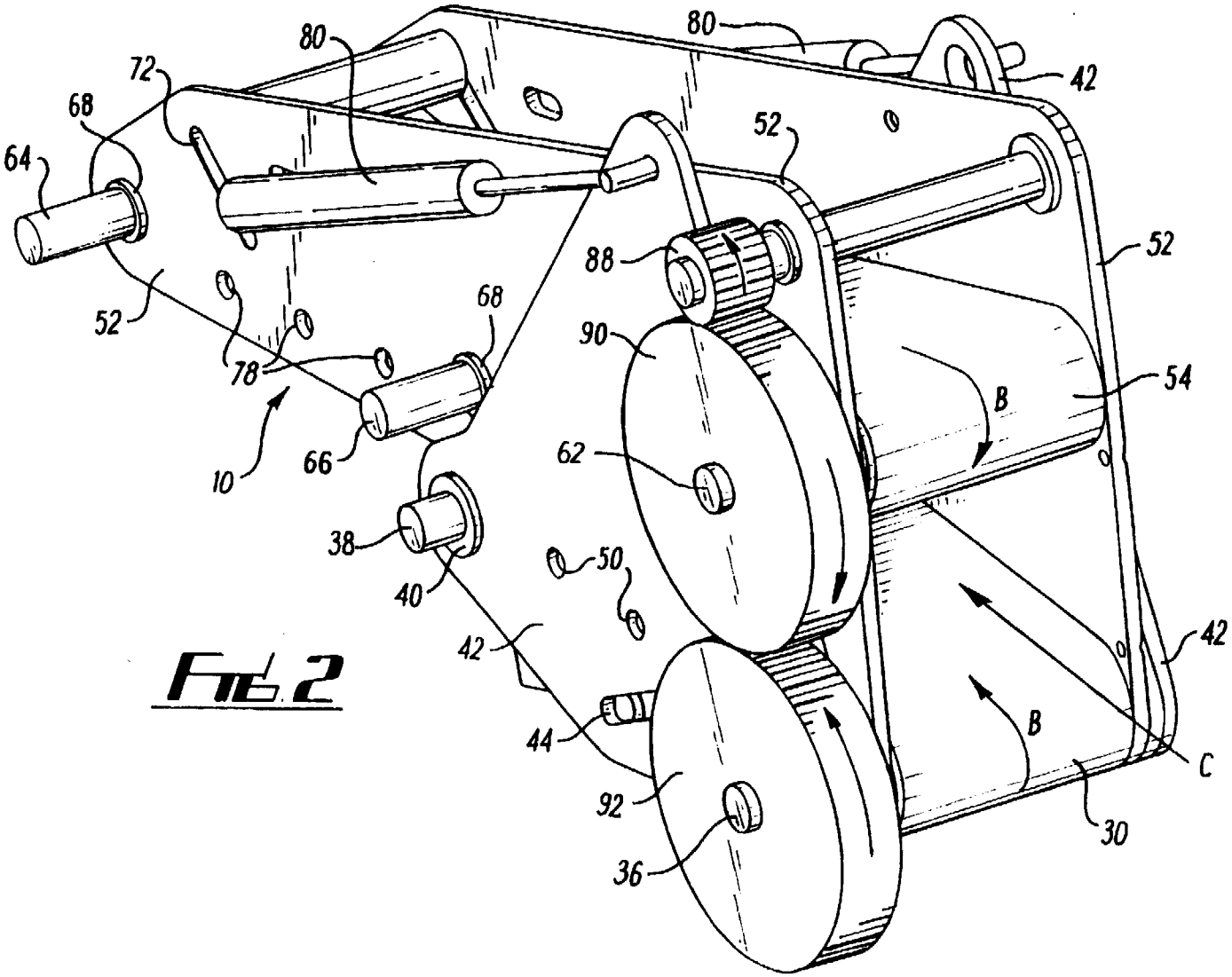
Figure 3:
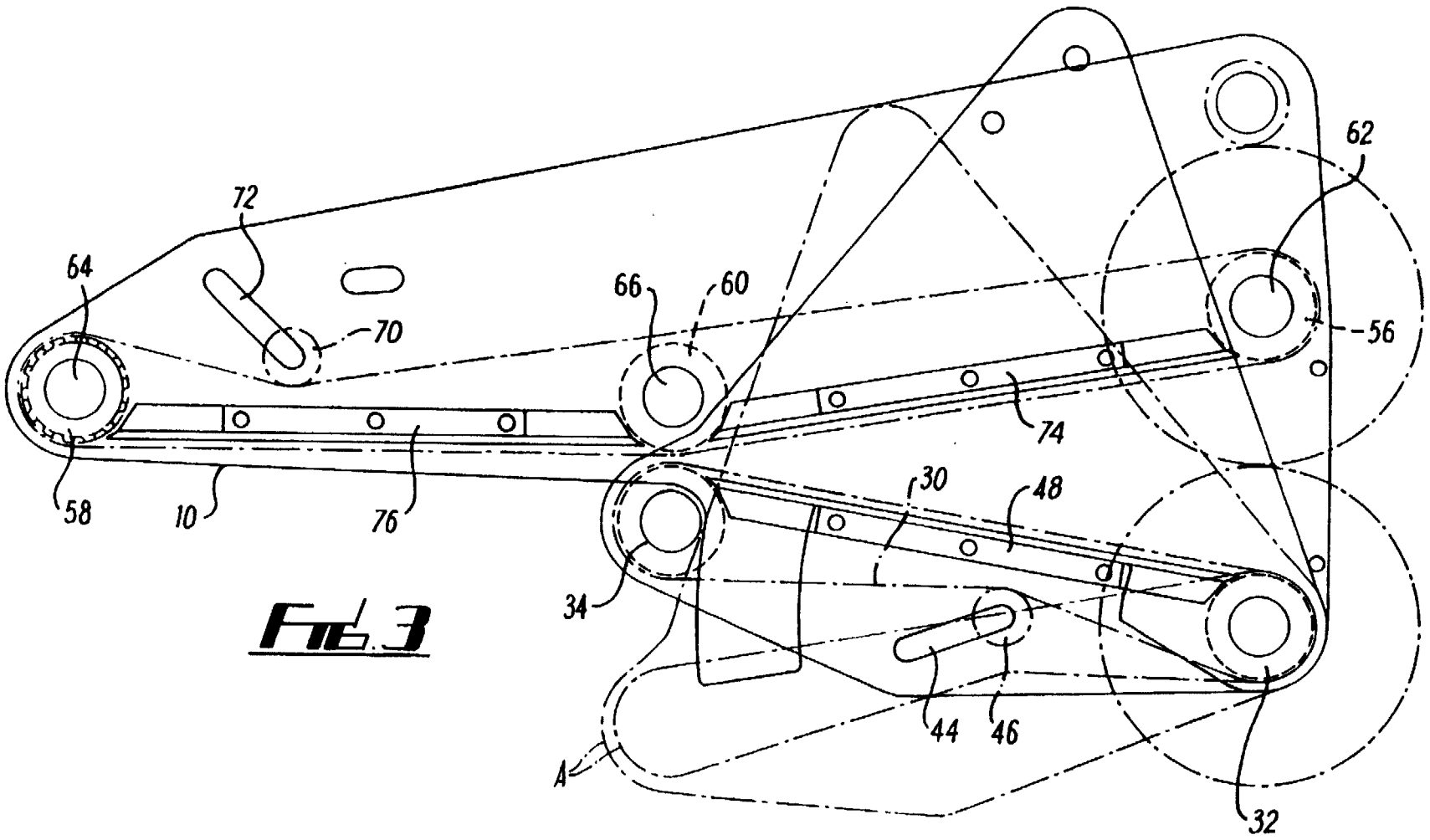
FIG. 3 shows a side elevation of the can crusher.

It will be observed particularly from FIG. 1 and 3 that the axes of the shafts 62,64,66, do not lie in a straight line but the axis of shaft 66 is displaced away from the line joining the axes of shafts 62,64. In the normal operating position illustrated in the drawings and particularly in full lines in FIG. 3 of the drawings, it will be clearly observed that the facing runs of the belts 30,54 converge between the leading end rollers 32,56 and the trailing end roller 34 of the first shorter belt and the intermediate roller 60 of the upper longer belt. This provides a converging space terminating in a nip, into which cans are fed in the direction of arrow C in FIG. 2 and it will be appreciated that if the belts are driven in a direction of arrows B, cans will be pulled into the crusher towards the nip and in so moving will be crushed so that when they pass between the nip defined by the rollers 34,66, they will be flattened.

Means are provided for biasing the upper and lower belt assemblies towards the normal operative relative position shown in the drawings with the nip at its minimum dimension. The means comprise a pair of gas springs 80 each mounted by one end of the upper extension of the plates 42 and by the other to the rearward extension of the plates 52.

It will be recalled that the plates 42,52 are pivotally mounted about the axis of shaft 36 so that if an object fed between the conveyor belts has a resistance to flattening which is greater than the biasing force exerted by the gas springs, the plates 52 will pivot relative to the plates 42 to cause the nip between the rollers 34,62 to temporarily increase against the biasing action of the gas springs to allow the item to pass therethrough. This action will also occur when a can cannot be flattened to the minimum dimension of the nip, for example, at its upper end.

The apparatus is driven by an electric motor 82 mounted to the plates 52 and driving, through a worm gear reduction gear box 84, a drive shaft 86 on which is mounted a spur gear 88 which meshes with a first drive gear 90 fixed to the drive shaft 62 for the leading guide roller 62 of the conveyor 54 and in turn meshing with a similar sized and toothed gear wheel 92 fixed to the drive shaft 36 on which the leading guide roller 32 for the first belt 32 is mounted. It will be realised therefore that the drive assembly drives the belts 30,54 in the same direction at the same speed and does not hinder the pivotal movement of the plates 52 relative to the plates 42.

The conveyor belt guide rollers 32,34,56,58 and 60 are all similarly toothed and corresponding toothed formations are provided on the inner faces of each belt such that the belts are positively driven in the manner of a timing belt.

The outer surface of the belts may be coated with hard-wearing abrasion resistant material.

It is preferable that the inner faces of at least the support plates, 48,74 and 76 are coated with a material having a low co-efficient of friction such that the belts 30,54 can readily slide over them.

Additionally, it is preferable that the plate 76 is magnetic such that magnetic cans emerging from the nip are held for a greater time to the downwardly facing surface of the belt 54 then non-magnetic cans such that non-magnetic cans are collected in a first receptacle placed close to the nip while magnetic cans are collected in a second receptacle placed close to the trailing roller 58.

It is preferable that a drive taken from one or other of the shafts 62,36 provides the means for rotating the rollers 20 of the can conveyor 14.

It will be appreciated that if a solid object is fed to the can crusher, the nip between rollers 34,60 will open against the biasing action of the gas springs 80 to allow it to pass therethrough without the apparatus stalling. This condition is shown by the chain lines A in FIG. 3.

It is preferable that the plates 52 are supported by a framework which also supports the casing enclosing the assembly. The casing has not been shown on the drawings but it will be appreciated that it incorporates a gated entry port at the upper end of the inclined plane 16. The port may be openable through the influence of the proximity switch arranged at the port and adapted to open an entry door only when suitable objects are introduced into the port, for example, electrically conductive objects and not, for example, lumps of wood or glass bottles. Actuation of the proximity switch can also be used to start the electric motor driving the apparatus which can run until a predetermined period after the entry port has closed.

It will be appreciated that the can crusher crushes cans continuously and not in a step-by-step operation, as a result the apparatus is unlikely to experience problems encountered by existing apparatus when a following can enters a crushing assembly designed to crush a single can and thereby cause the apparatus to stall. A continuous line of cans can be processed by the present apparatus without the need to provide a gating assembly to ensure that only a single can is presented to the crusher at one particular time.

Figure 4:
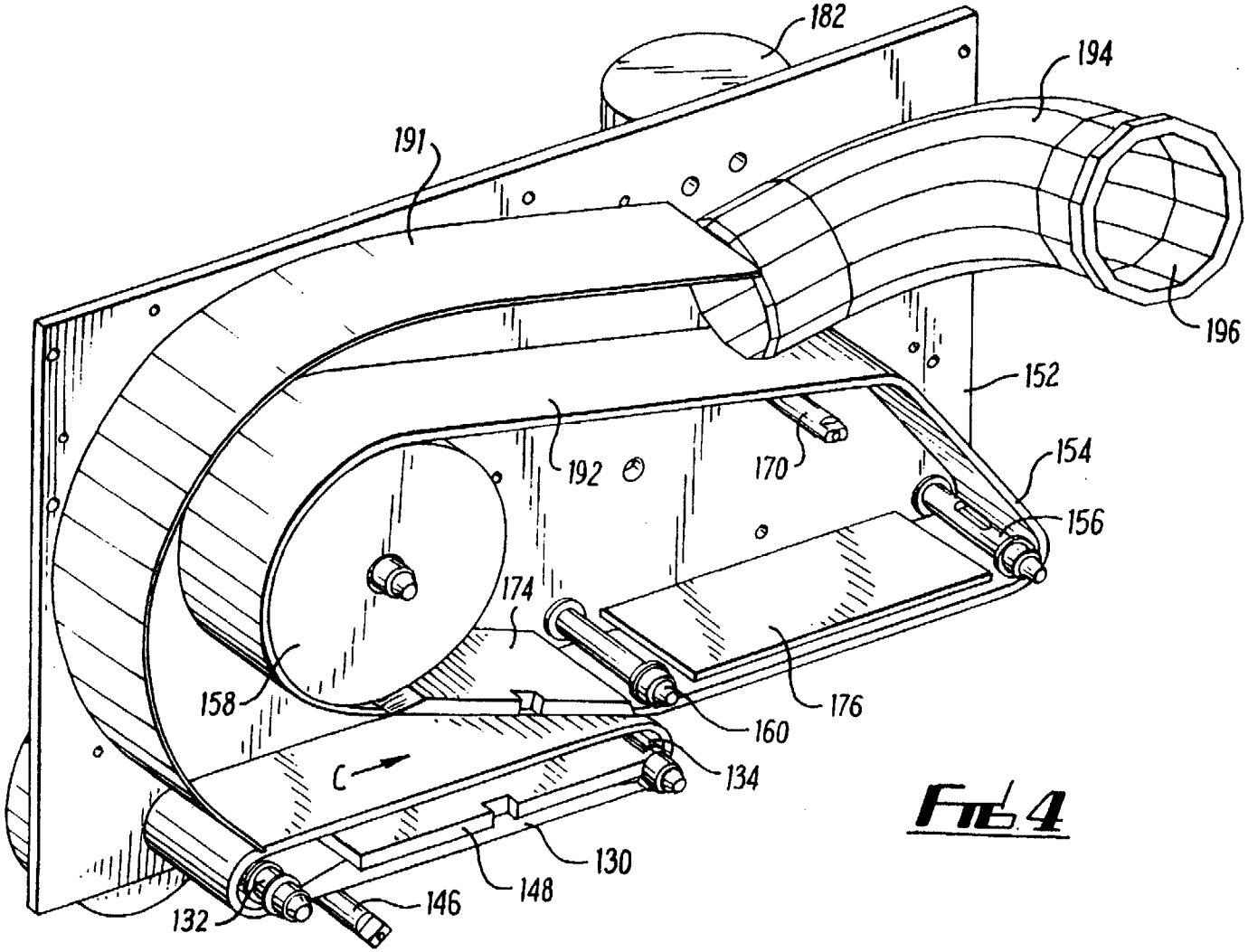
FIG. 4 shows a perspective view of another embodiment of a can crusher in which a side plate of the can crusher and other components have been omitted for clarity.
Figure 5:
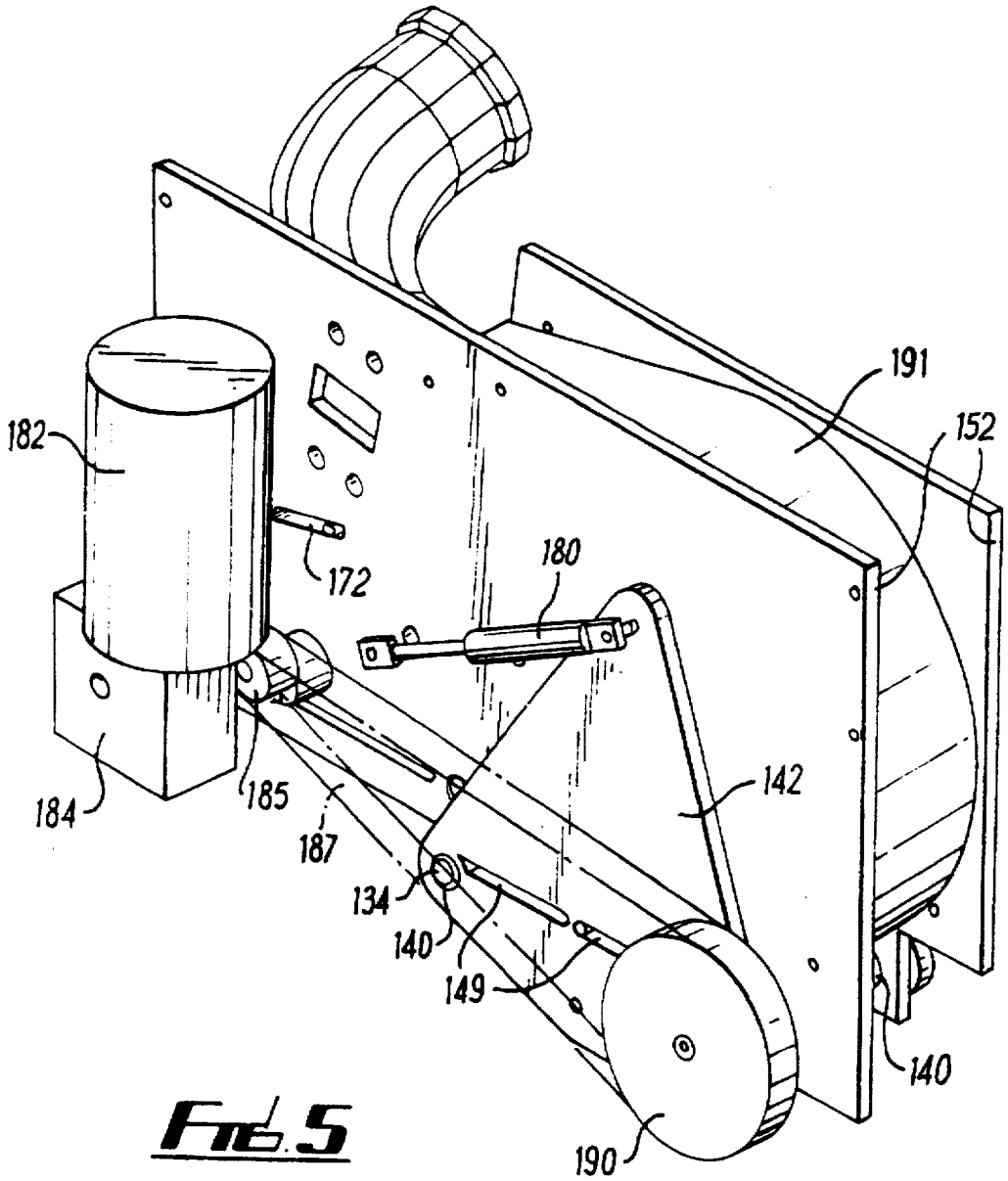
FIG. 5 shows a further perspective view of the can crusher taken from the opposite side, with both plates in position.

A second embodiment of the can crusher of the present invention is shown in FIGS. 4 and 5. In this embodiment a powered can delivery means is not required and one of the conveyor belt assemblies is used to deliver cans to the crushing zone whilst ensuring that the crushing zone is spaced from the entry to the crusher by a distance which is sufficiently great to prevent a person reaching into the crushing zone by way of the can entry port.

This second embodiment is similar to the first embodiment in that it comprises two conveyor belt assemblies, the first of these is an endless belt 130 which runs over a driven leading end guide roller 132 and a trailing end idler roller 134 each mounted in bearings 140 supported in triangular side plates 142. The plates 142 have corresponding slots (not shown) and a tensioning roller 146 is mounted on a shaft which is adjustably mounted between the slots such that the first conveyor belt can be suitably tensioned. A support plate 148 is supported in slot 149 in the side plates 142 below the upper run of the belt 130.

A second pair of spaced apart rectangular plates 152 are mounted between the plates 142. The shaft of the roller 132 passes through the second plates 152 so that the plates 142 pivot in unison about said shaft relative to the plates 152. The second endless belt 154 is carried by a driven leading guide roller 156, idling trailing end guide drum 158, idling intermediate guide roller 160 and a tensioning roller 170 mounted between the plates 152 in corresponding slots 172 whereby its position, and consequently the tension it exerts in the return run of the belt, is adjustable. The lower run of the belt 154 has support plates 174,176 placed alongside its inner surface, the plates being mounted between the side plates 152.

It will be observed that the runs of the belt passing over the support plates 148 and 174 respectively are not parallel but converge to the normal operating position shown in the drawings and define a nip between the rollers 134 and 160. It will also be observed, however, that when a can is fed into the nip in the direction of arrow C in FIG. 4 it will be crushed and flattened but allowed to pass through the nip in its flattened condition by pivotal movements of the plates 142 relative to the plates 152 thereby allowing the roller 134 to move away from the roller 160 against the action of a biasing force.

Means are provided for biasing the belt assemblies towards the normal operative relative protection shown in the drawings. The means comprise a pair of gas-springs 180 each mounted by one end to the upper apex of the triangular plates 142 and by the other to the plates 152. By this method, if a can or other "foreign" obstacle, for example, a block of wood, is fed to the can crusher, the crusher will not be damaged as the first conveyor assembly will pivot away from the second conveyor assembly against the action of the biasing means 180 allowing the non flattened object to pass through the nip.

As before, means are provided for separating magnetic material from non-magnetic material. This is achieved by ensuring that plate 176 is magnetised so that any magnetic material passing through the nip is held against the outer surface of the second belt assembly by the magnetic action of the plate 176 until the belt reaches driven roller 156 at which stage the object falls into an appropriate container located generally below the roller 156. On the other hand, a non-magnetic flattened can passing through the nip falls directly off the belt at the nip into a second container placed therebelow.

As can be seen from FIG. 5, the apparatus is driven by an electric motor 182 mounted to one of the plates 152 and driving, through a gearbox 184, a drive pulley 185 which, by means of a drive belt 187, rotates a drive pulley 190 rigidly mounted to the shaft of the leading end drive roller 132 of the first conveyor belt assembly. Another output shaft from the gear box 182 drives the drive roller 156 of the second conveyor belt assembly.

A casing 191 is mounted between the side plates 152 and surrounds part of the upper run of the second belt 154 and the end of that belt passing round the idler drum 158 so that a can to be crushed delivered to the top run 192 of the second belt by a delivery chute 194 leading from an entry port 196 in a casing (not shown) for the crusher is conveyed over the top of the first belt, around its end and on to the top of the belt 130 of the first conveyor assembly so that it travels in the direction of the arrow C into the nip thereby being crushed.

The belts and rollers of the second assembly can be similar to that of the first assembly, for example, they can be toothed and have special surface treatments.

Various modifications can be made without departing from the scope of the present invention, for example, the arrangement of conveyor belts can be altered, provided that they provide a converging space in which cans are crushed. The belts could be arranged with their surfaces vertically, rather than horizontally, as shown in the drawings. Alternative means can be employed to mount the belts and alternative biasing means could be employed, for example, coil springs could replace the gas springs.

I claim:

1. A can crusher including two endless belt assemblies arranged alongside each other with facing runs of said belt assemblies being arranged to define a converging passage therebetween in a direction of motion of the belts, one belt assembly being located generally adjacent the other and one being pivotally mounted relative to the other whereby an angle of convergence of the passage and a gap between the belts at its smallest point are variable, biasing means to bias the facing runs of the endless belt assemblies toward each other, a pair of facing plates between which the pivotally mounted endless belt assembly is mounted, the pair of plates being pivotally mounted about an axis of rotation of a drive roller of the pivotally mounted belt assembly, and wherein the biasing means biases the pair of facing plates and the pivotally mounted belt assembly relative to the other belt assembly.

2. A can crusher as claimed in claim 1, including a second pair of facing plates between which the other endless belt assembly is mounted and the biasing means being mounted at one end to a first plate and at the other to a second plate.

3. A can crusher as claimed in claim 2, in which a casing is provided between the second pair of plates around an idler end of the second belt assembly and part of a return run thereof to guide cans to be crushed around the idler end to the converging passage between belts of the belt assemblies.

4. A can crusher as claimed in claim 1, in which the biasing means is a pair of air springs.

5. A can crusher as claimed in claim 1, in which the pivotally mounted belt assembly is shorter than the other belt assembly.

6. A can crusher as claimed in claim 1, in which said other belt assembly has an intermediate guide roller arranged alongside a trailing end guide roller of the pivotally mounted belt assembly to define a nip at the inner end of the converging passage between the facing runs of the belt assemblies.

7. A can crusher as claimed in claim 1, in which backing plates are arranged against the inner faces of said facing runs of each belt.

8. A can crusher as claimed in claim 1, in which adjustable tensioning rollers are provided to co-act with a return run of each belt assembly to tension the belts.

9. A can crusher as claimed in claim 1, in which the biasing means are adjustable.

10. A can crusher as claimed in claim 1, in which the belts are operatively connected so as to be driven at the same linear speed.

11. A can crusher including two endless belt assemblies arranged alongside each other with the facing runs of said belt assemblies being arranged to define a converging passage therebetween in the direction of motion of the belts, one belt assembly being located generally adjacent the other and one being pivotally mounted relative to the other whereby the angle of convergence of the passage and the gap between the belts at its smallest point are variable, including biasing means to bias the facing runs of the endless belt assemblies towards each other, a first pair of facing plates between which the first endless belt assembly is mounted, a second pair of facing plates between which the second endless belt assembly is mounted, the first pair of plates being pivotally mounted about an axis relative to the second pair and the biasing means being mounted at one end to a first plate and at the other to a second plate, and in which the first endless belt assembly has a drive roller the axis of rotation of which is incident with the axis about which relative pivotal movement between the first and second pairs of plates take place.

12. A can crusher as claimed in claim 11, in which the biasing means is a pair of air springs.

13. A can crusher as claimed in claim 11, in which the first belt assembly is shorter than the second belt assembly.

14. A can crusher as claimed in claim 11, in which backing plates are arranged against the inner faces of said facing runs of each belt.

15. A can crusher as claimed in claim 11, in which adjustable tensioning rollers are provided to co-act with a return run of each belt assembly to tension the belts.

16. A can crusher as claimed in claim 11, in which the biasing means are adjustable.

17. A can crusher as claimed in claim 11, in which the belts are operatively connected so as to be driven at the same linear speed.

18. A can crusher including two endless belt assemblies arranged alongside each other with the facing runs of said belt assemblies being arranged to define a converging passage therebetween in the direction of motion of the belts, one belt assembly being located generally adjacent the other and one being pivotally mounted relative to the other whereby the angle of convergence of the passage and the gap between the belts at its smallest point are variable, including biasing means to bias the facing runs of the endless belt assemblies towards each other, a first pair of facing plates between which the first endless belt assembly is mounted, a second pair of facing plates between which the second endless belt assembly is mounted, the first pair of plates being pivotally mounted about an axis relative to the second pair and the biasing means being mounted at one end to a first plate and at the other to a second plate, in which said second belt assembly has an intermediate guide roller arranged alongside a trailing end guide roller of the first belt assembly to define a nip at the inner end of the converging passage between the facing runs of the belt assemblies.

19. A can crusher including two endless belt assemblies arranged alongside each other with the facing runs of said belt assemblies being arranged to define a converging passage therebetween in the direction of motion of the belts, one belt assembly being located generally adjacent the other and one being pivotally mounted relative to the other whereby the angle of convergence of the passage and the gap between the belts at its smallest point are variable, including biasing means to bias the facing runs of the endless belt assemblies towards each other, a first pair of facing plates between which the first endless belt assembly is mounted, a second pair of facing plates between which the second endless belt assembly is mounted, the first pair of plates being pivotally mounted about an axis relative to the second pair and the biasing means being mounted at one end to a first plate and at the other to a second plate, in which a casing is provided between the second pair of plates around an idler end of the second belt assembly and part of a return run thereof to guide cans to be crushed around the idler end to the converging passage between belts of the first and second belt assemblies.

* * * * *